US008579670B2

(12) United States Patent
Peterson et al.

(10) Patent No.: US 8,579,670 B2
(45) Date of Patent: Nov. 12, 2013

(54) ENERGY SAVING GAS DISCHARGE LAMP INCLUDING A XENON-BASED GASEOUS MIXTURE

(71) Applicants: John Peterson, Gloucester, MA (US); Daniel Marian, Georgetown, KY (US); Paul Salvi, Versailles, KY (US)

(72) Inventors: John Peterson, Gloucester, MA (US); Daniel Marian, Georgetown, KY (US); Paul Salvi, Versailles, KY (US)

(73) Assignee: OSRAM SYLVANIA Inc., Danvers, MA (US)

( * ) Notice: Subject to any disclaimer, the term of this patent is extended or adjusted under 35 U.S.C. 154(b) by 0 days.

(21) Appl. No.: 13/800,793

(22) Filed: Mar. 13, 2013

(65) Prior Publication Data

US 2013/0196564 A1 Aug. 1, 2013

Related U.S. Application Data

(62) Division of application No. 13/041,498, filed on Mar. 7, 2011, now Pat. No. 8,421,333.

(51) Int. Cl.
*H01J 9/00* (2006.01)

(52) U.S. Cl.
USPC ..... 445/25; 445/9; 445/13; 445/16; 445/26; 445/53; 445/58; 427/59

(58) Field of Classification Search
None
See application file for complete search history.

(56) References Cited

U.S. PATENT DOCUMENTS

| | | | | |
|---|---|---|---|---|
| 2,714,684 | A | 8/1955 | Meister et al. | |
| 2,714,685 | A | 8/1955 | Meister et al. | |
| 3,013,169 | A | 12/1961 | Gungle et al. | |
| 3,373,303 | A | 3/1968 | Evans | |
| 3,780,330 | A | 12/1973 | Otsuka et al. | |
| 5,187,415 | A | 2/1993 | Osawa et al. | |
| 6,031,330 | A | 2/2000 | Yoshida et al. | |
| 6,400,097 | B1 | 6/2002 | Jin et al. | |
| 6,583,566 | B1 | 6/2003 | Jin et al. | |
| 7,800,291 | B2 | 9/2010 | Beers et al. | |
| 2002/0131554 | A1 * | 9/2002 | Fleming et al. | 378/119 |
| 2004/0004441 | A1 | 1/2004 | Yano | |
| 2006/0226781 | A1 * | 10/2006 | Allen et al. | 313/594 |
| 2009/0079324 | A1 | 3/2009 | Deme et al. | |
| 2010/0246188 | A1 | 9/2010 | Walton | |

FOREIGN PATENT DOCUMENTS

| | | | |
|---|---|---|---|
| KR | 10-2005-0088900 | A | 9/2005 |
| KR | 10-2008-0110302 | A | 12/2008 |

OTHER PUBLICATIONS

Yang Ki Sung, International Search Report and Written Opinion of the International Searching Authority for PCT/US2012/025160, Sep. 17, 2012, pp. 1-8, Korean Intellectual Property Office, Daejeon, Republic of Korea.

* cited by examiner

*Primary Examiner* — Ashok Patel
(74) *Attorney, Agent, or Firm* — Shaun P. Montana; Yiming Zhang

(57) ABSTRACT

An energy saving gas discharge lamp, and method of making same, is provided. The gas discharge lamp includes a light-transmissive envelope, and an electrode within the light-transmissive envelope to provide a discharge. A light scattering reflective layer is disposed on an inner surface of the light-transmissive envelope. A phosphor layer is coated on the light scattering reflective layer. A discharge-sustaining gaseous mixture is retained inside the light-transmissive envelope. The discharge-sustaining gaseous mixture includes more than 80% xenon, by volume, at a low pressure.

6 Claims, 2 Drawing Sheets

ENERGY SAVING GAS DISCHARGE LAMP INCLUDING A XENON-BASED GASEOUS MIXTURE

CROSS-REFERENCE TO RELATED APPLICATION

The present application is a divisional application of, and claims priority to, U.S. patent application Ser. No. 13/041,498, filed Mar. 7, 2011 and entitled "ENERGY SAVING GAS DISCHARGE LAMP INCLUDING A XENON-BASED GASEOUS MIXTURE", now U.S. Pat. No. 8, 421, 333, the entire contents of which are hereby incorporated by reference.

TECHNICAL FIELD

The present application relates to lamps, and in particular to low pressure discharge lamps.

BACKGROUND

Due to current global demands, lamps with better energy conservation features and minimum replacement cost are highly desirable. For example, a common type of low-energy use lamp is the 32 watt, T8 four-foot linear fluorescent lamp. The ballast that supplies the power to this lamp is a constant current, high frequency ballast. Millions of such ballasts have been installed to operate such lamps. These ballasts operate the lamps at a particular current designed to cause a discharge in the lamp, leading to the emission of light.

In addition to using a low-energy fluorescent lamp, one may achieve further energy savings by using a ballast that operates the lamp at a lower lamp current than a conventional ballast.

SUMMARY

A lamp current that is lower than the typical current provided to a low-energy fluorescent lamp causes the mercury vapor within the lamp to operate under a non-optimized pressure. A traditional low pressure discharge lamp (such as a low-energy fluorescent lamp) will not operate at its optimized efficiency with a ballast that provides a lower lamp current than is typically used. Therefore, both the lamp and the ballast have to be replaced to achieve the energy savings. However, replacing large quantities of such ballasts may be costly. Thus, there is a need for an energy saving gas discharge lamp with a low replacement cost that is able to operated at a lower than conventional lamp current.

Embodiments of the invention overcome these limitations by utilizing a xenon-argon discharge-sustaining gaseous mixture, at a low lamp fill pressure. A preferred advantage of such a lamp is that the lamp consumes significantly less power (and thus uses significantly fewer watts) than a conventional fluorescent lamp. This allows the lamp to be operated by a ballast that provides a lower than conventional current. The xenon-argon filled lamps may thus serve as drop-in replacements on such ballasts. Furthermore, the xenon-argon filled lamps may offer preferred benefits of improved starting characteristics and higher lamp efficiency on high frequency operation.

In an embodiment, there is provided a gas discharge lamp. The gas discharge lamp includes a light-transmissive envelope, and an electrode within the light-transmissive envelope to provide a discharge. A light scattering reflective layer is disposed on an inner surface of the light-transmissive envelope. A phosphor layer is coated on an inner surface of the light scattering reflective layer. A discharge-sustaining gaseous mixture is retained inside the light-transmissive envelope. The discharge-sustaining gaseous mixture includes more than 80% xenon, by volume, at a low pressure.

In a related embodiment, the discharge-sustaining gaseous mixture may include about 85% xenon and 15% argon, by volume at a low pressure. In another related embodiment, the low pressure of the discharge-sustaining gaseous mixture inside the light-transmissive envelope may be about 1.5 Torr. In yet another related embodiment, the phosphor layer may include a blended triphosphor system of red, green, and blue color-emitting rare earth phosphors. In still another related embodiment, the mean particle diameter of the phosphor layer may be about 12 micrometers.

In yet still another related embodiment, the phosphor layer may have a coating weight of about 4 milligrams per square centimeter. In still yet another related embodiment, the light scattering reflective layer may contain fumed alumina. In yet still another related embodiment, the light scattering reflective layer may have a coating weight of about 0.15 milligrams per square centimeter.

In still yet another related embodiment, the discharge-sustaining gaseous mixture may include at least two gases. One of the at least two gases may be xenon.

In another embodiment, there is provided a gas discharge lamp. The gas discharge lamp includes a light-transmissive envelope, and an electrode within the light-transmissive envelope to provide a discharge. A fumed alumina layer is disposed on the inner surface of the light-transmissive envelope. The fumed alumina layer has a coating weight of about 0.15 milligrams per square centimeter. A phosphor layer is coated on an inner surface of the light scattering reflective layer. The phosphor layer includes a blended triphosphor system of red, green, and blue color-emitting rare earth phosphors. The phosphor layer has a coating weight of about 4 milligrams per square centimeter. The mean particle diameter of the phosphor layer is about 12 micrometers. A discharge-sustaining gaseous mixture is retained inside the light-transmissive envelope. The discharge-sustaining gaseous mixture includes about 85% xenon and 15% argon, by volume. The pressure of the discharge-sustaining gaseous mixture inside the light-transmissive envelope is about 1.5 Torr.

In a related embodiment, the discharge-sustaining gaseous mixture may include at least two gases. One of the at least two gases may be xenon.

In another embodiment, there is provided a method of providing a gas discharge lamp including mercury vapor. The method includes: joining a light-transmissive envelope with an electrode, wherein the electrode is to provide a discharge; disposing a light scattering reflective layer on an inner surface of the light-transmissive envelope; coating a phosphor layer on an inner surface of the light scattering reflective layer; dispensing mercury inside the light-transmissive envelope; and supplying a gaseous mixture inside the light-transmissive envelope, wherein the gaseous mixture includes more than 80% xenon, by volume, at a low pressure.

In a related embodiment, coating a phosphor layer may include coating a phosphor layer including a blended triphosphor system of red, green, and blue color-emitting rare earth phosphors on an inner surface of the light scattering reflective layer. In another related embodiment, coating a phosphor layer may include coating a phosphor layer that has a mean particle diameter of about 12 micrometers on an inner surface of the light scattering reflective layer. In yet another related embodiment, supplying a gaseous mixture may include supplying a gaseous mixture that contains about 85% xenon and 15% argon, by volume, at a low pressure, inside the light-transmissive envelope. In still another related embodiment, supplying a gaseous mixture may include supplying a gaseous mixture that contains more than 80% xenon, by volume, at a pressure of 1.5 Torr, inside the light-transmissive envelope. In yet still another related embodiment, supplying a gaseous mixture may include supplying a gaseous mixture that contains more than 80% xenon, by volume, and at least one other gas, at a low pressure, inside the light-transmissive envelope.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
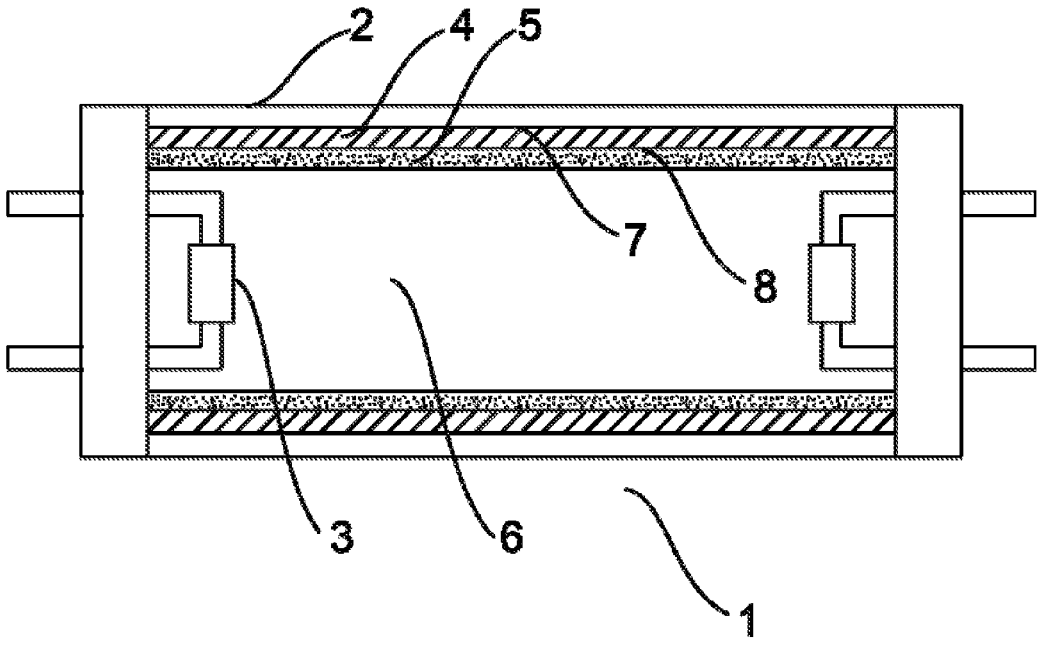
FIG. 1 shows a component view of a gas discharge lamp including a gaseous mixture of more than 80% xenon by volume, according to embodiments described herein.

Referring now to the drawings with greater particularity, FIG. 1 shows a gas discharge lamp 1. Though embodiments are described herein with regards to a linear fluorescent lamp, various changes and modifications may be made as understood by one of ordinary skill in the art without departing from the scope of the invention. For example, the referred gas discharge lamp can be, but is not limited to, any model of low pressure discharge lamps including compact fluorescent lamps. The gas discharge lamp 1 includes a light-transmissive envelope 2. The light-transmissive envelope 2 is, in some embodiments, generally tubular. In some embodiments, the light-transmissive envelope 2 is straight in shape. Alternatively, or additionally, the light-transmissive envelope 2 may be bent in a circular shape. Further, in other embodiments, the light-transmissive envelope 2 may take other shapes, such that any shape is possible within the knowledge of persons having ordinary skill in the art as described herein. The light-transmissive envelope 2 contains at least one electrode 3 to provide a discharge. The discharge is necessary to excite the mercury vapor inside the light-transmissive envelope 2. Some embodiments may include more than one electrode 3, such as is shown in FIG. 1. In embodiments where there is a plurality of electrodes, the electrodes 3 may be arranged on one end of the light-transmissive envelope 2. Alternatively, the electrodes 3 may be arranged on opposing ends of the light-transmissive envelope 2.

The light-transmissive envelope 2 preferably contains two layers on an inner surface 7 of the light-transmissive envelope 2. A light scattering reflective layer 4 is disposed on the inner surface 7 of the light-transmissive envelope 2. In addition to scattering light generated within the gas discharge lamp 1, the light scattering reflective layer 4 may also serve as a mercury barrier. In some embodiments, the light scattering reflective layer 4 is formed from fumed alumina because fumed alumina has high ultraviolet (UV) light reflectance and good visible light transmittance, the importance of which is described in greater detail below. Of course, any known light scattering reflective material may be used, regardless of its UV light reflectance properties. In some embodiments, the light scattering reflective layer 4 is disposed on the entire inner surface 7 of the light-transmissive envelope 2. Alternatively, in other embodiments, the light scattering reflective layer 4 is disposed on a portion of the inner surface 7 of the light-transmissive envelope 2. The light scattering reflective layer 4, in some embodiments, has a coating weight of 0.15 milligrams per square centimeters. A phosphor layer 5 is coated on an inner surface 8 of the light scattering reflective layer 4. The phosphor layer 5 serves to achieve a variety of spectral power distributions and colors for the gas discharge lamp 1. In some embodiments, the phosphor layer 5 is a blended triphosphor system of red, green, and blue color-emitting rare earth phosphors. Alternatively, in other embodiments, other variations of such a phosphor may be used. The coating weight of the phosphor layer 5 may be, and in some embodiments, is, four milligrams per square centimeter. The mean particle diameter of the phosphor layer 5 may be, but is not limited to, twelve micrometers. In some embodiments, the phosphor layer 5 is coated on the entire inner surface 8 of the light scattering reflective layer 4. Alternatively, in other embodiments, the phosphor layer 5 is coated on a portion of the inner surface 8 of the light scattering reflective layer 4. The coating weights and mean particle diameter of the light scattering reflective layer 4 and the phosphor layer 5 are optimized in view of the corresponding percentage of the xenon inside the light-transmissive envelope 2, to achieve better lamp efficacy.

The light scattering reflective layer 4 reflects any UV light not initially captured by the phosphor layer 5 back into the phosphor layer 5, thereby maximizing the effectiveness of the phosphor layer 5. The light scattering reflective layer 4 also serves as a barrier layer so as to prevent migration of mercury into the glass tube during usage. By preventing migration of mercury into the glass that causes graying and reduces efficiency, fumed alumina increases service life and efficiency of the gas discharge lamp 1.

The gas discharge lamp 1 contains mercury dispensed inside of the light-transmissive envelope 2. A discharge-sustaining gaseous mixture, denoted generally by 6, is supplied at a low pressure inside of the light-transmissive envelope 2. Beside the mercury vapor, the discharge-sustaining gaseous mixture comprises at least two gases, and one of the at least two gases is xenon. The discharge-sustaining gaseous mixture 6 contains more than 80% xenon, by volume. In some embodiments, discharge-sustaining gaseous mixture 6 may contain less than 98% xenon. The low pressure of the discharge-sustaining gaseous mixture 6 may range from the order $10^{-6}$ to the order of $10^{-3}$ atmosphere, according to the known state of the art in low pressure gas discharge lamps.

In some embodiments, the gas discharge lamp 1 contains a discharge-sustaining gaseous mixture 6 of about 85% xenon and 15% argon at a pressure of about 1.5 torr, at the conventional fill temperature as known in the art, for example but not limited to 25° C. The high percentage of xenon and low pressure enable the lamp to be operated at a lower wattage (and thus on a lower current than a typical low pressure gas discharge lamp) while maintaining high lamp efficiency, particularly on a high-frequency ballast. In addition, the higher percentage of xenon may allow a lower ignition voltage and a shorter glow time as compared to conventional low pressure gas discharge lamps. The lower ignition voltage may have an advantage of lowering ballast cost and may provide lamps the ability to have longer lead wire length on the ballast. In addition, with the shorter glow time, there may be an increase of the life of the lamp.

In some embodiments, the gas discharge lamp may serve as a drop-in replacement on a conventional low frequency ballast with an output frequency of 60 Hz. For instance, a T8 gas discharge lamp containing a discharge-sustaining gaseous mixture of about 85% xenon and 15% argon at a pressure of about 1.5 torr may achieve a energy consumption of 22 watts, on a conventional low frequency ballast with an output frequency of 60 Hz. Furthermore, the lamp may achieve a 17.4% gain in efficacy from operating at 60 Hz to operating at 25 kHz. In some embodiments, the gas discharge lamp may achieve a high efficacy on a high frequency ballast. The high frequency of the ballast may be, but is not limited to, 25 kHz to 100 kHz, preferably 25 kHz to 45 kHz. For instance, a gas discharge lamp containing a discharge-sustaining gaseous mixture of about 85% xenon and 15% argon at a pressure of about 1.5 torr may achieve an energy consumption of 19 watts, on a high frequency ballast with an output frequency of 25 kHz.

Figure 2:
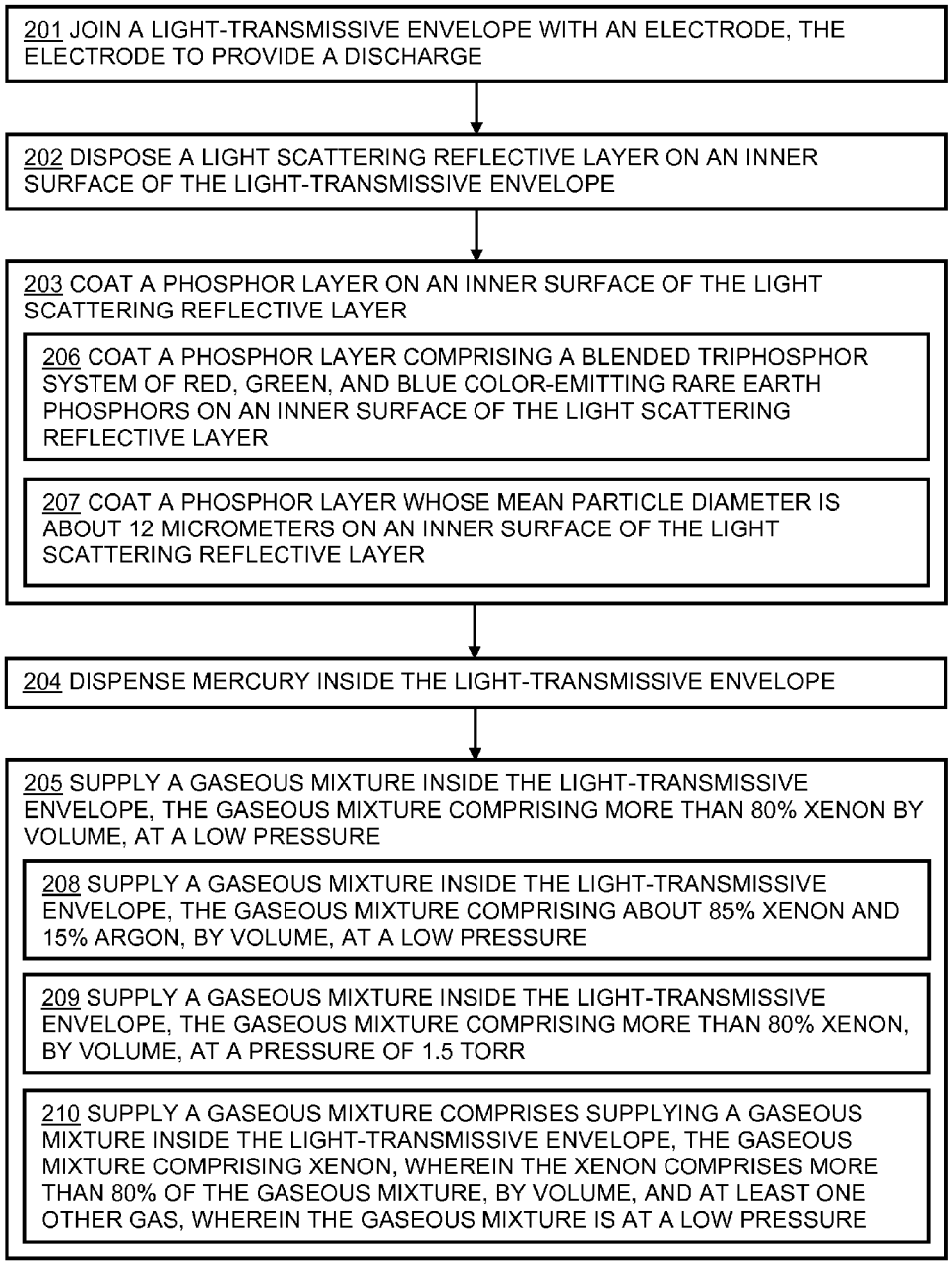
FIG. 2 is a flowchart of a method of providing a gas discharge lamp including a gaseous mixture of more than 80% xenon by volume, according to embodiments described herein.

In some embodiments, the gas discharge lamp 1 shown in FIG. 1 may be constructed according to a method shown in FIG. 2. First, a light-transmissive envelope is joined with an electrode, step 201, the electrode to provide a discharge. Second, a light scattering reflective layer is disposed on an inner surface of the light-transmissive envelope, step 202. Third, a phosphor layer is coated on the inner surface of the light scattering reflective layer, step 203. Fourth, mercury is dispensed inside the light-transmissive envelope, step 204. Fifth, a discharge-sustaining gaseous mixture is supplied inside the light-transmissive envelope, step 205, the discharge-sustaining gaseous mixture comprising at least 80% xenon, by volume, at a low pressure.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A method of providing a gas discharge lamp including mercury vapor, the method comprising:

joining a light-transmissive envelope with an electrode, the electrode to provide a discharge;

disposing a light scattering reflective layer on an inner surface of the light-transmissive envelope;

coating a phosphor layer on an inner surface of the light scattering reflective layer;

dispensing mercury inside the light-transmissive envelope; and supplying a gaseous mixture inside the light-transmissive envelope, the gaseous mixture comprising more than 80% xenon, by volume, at a low pressure.

2. The method of claim 1, wherein coating a phosphor layer comprises coating a phosphor layer comprising a blended triphosphor system of red, green, and blue color-emitting rare earth phosphors on an inner surface of the light scattering reflective layer.

3. The method of claim 1, wherein coating a phosphor layer comprises coating a phosphor layer whose mean particle diameter is about 12 micrometers on an inner surface of the light scattering reflective layer.

4. The method of claim 1, wherein supplying a gaseous mixture comprises supplying a gaseous mixture inside the light-transmissive envelope, the gaseous mixture comprising about 85% xenon and 15% argon, by volume, at a low pressure.

5. The method of claim 1, wherein supplying a gaseous mixture comprises supplying a gaseous mixture inside the light-transmissive envelope, the gaseous mixture comprising more than 80% xenon, by volume, at a pressure of 1.5 Torr.

6. The method of claim 1 wherein supplying a gaseous mixture comprises supplying a gaseous mixture inside the light-transmissive envelope, the gaseous mixture comprising xenon, wherein the xenon comprises more than 80% of the gaseous mixture, by volume, and at least one other gas, wherein the gaseous mixture is at a low pressure.

* * * * *